US010648250B2

(12) United States Patent
Peveri

(10) Patent No.: US 10,648,250 B2
(45) Date of Patent: May 12, 2020

(54) ELEVATOR DEVICE FOR DRILLING SYSTEMS

(71) Applicant: WELL EQUIPMENTS INTERNATIONAL S.r.l., Fiorenzuola d'Arda (IT)

(72) Inventor: Luigi Peveri, Fiorenzuola d'Arda (IT)

(73) Assignee: WELL EQUIPMENTS INTERNATIONAL S.R.L., Fiorenzuola d'Arda (PC) (IT)

( * ) Notice: Subject to any disclaimer, the term of this patent is extended or adjusted under 35 U.S.C. 154(b) by 45 days.

(21) Appl. No.: 15/320,266

(22) PCT Filed: Jun. 16, 2015

(86) PCT No.: PCT/IB2015/000974
§ 371 (c)(1),
(2) Date: Dec. 19, 2016

(87) PCT Pub. No.: WO2015/193720
PCT Pub. Date: Dec. 23, 2015

(65) Prior Publication Data

US 2017/0159380 A1 Jun. 8, 2017

(30) Foreign Application Priority Data

Jun. 18, 2014 (IT) ..... MI2014A1104

(51) Int. Cl.

| | |
|---|---|
| ***E21B 19/06*** | (2006.01) |
| ***E21B 19/07*** | (2006.01) |
| ***E21B 19/15*** | (2006.01) |
| ***E21B 19/16*** | (2006.01) |
| ***E21B 19/20*** | (2006.01) |

(52) U.S. Cl.
CPC ..... *E21B 19/155* (2013.01); *E21B 19/06* (2013.01); *E21B 19/16* (2013.01); *E21B 19/20* (2013.01)

(58) Field of Classification Search
CPC ..... E21B 19/06; E21B 19/07; E21B 19/155; E21B 19/16; E21B 19/20
See application file for complete search history.

(56) References Cited

U.S. PATENT DOCUMENTS 3,915,244 A * 10/1975 Brown ..... E21B 19/07 175/85
4,655,302 A * 4/1987 McCreadie ..... E21B 21/106 166/339
5,036,927 A * 8/1991 Willis ..... E21B 3/02 166/77.51
5,297,833 A * 3/1994 Willis ..... E21B 19/07 175/162

(Continued)

OTHER PUBLICATIONS

International Search Report dated Oct. 1, 2015.

*Primary Examiner* — Matthew R Buck
(74) *Attorney, Agent, or Firm* — Hedman & Costigan, P.C.; James V. Costigan; Kathleen A. Costigan

(57) ABSTRACT

An elevator device for drilling systems consisting substantially of a lifting device (2) cooperating with a loading device (3) applied to a drilling machine (4); said lifting device (2) taking a rod (100) or a casing (101) from a horizontal position to successively engage said rod or casing in a driving head (5) of a drilling machine (4), said device being directly mounted on the driving head and being driven by said driving head.

11 Claims, 8 Drawing Sheets

(56) References Cited

U.S. PATENT DOCUMENTS

| | | | | |
|---|---|---|---|---|
| 7,140,445 | B2 * | 11/2006 | Shahin | E21B 7/20 166/380 |
| 7,854,265 | B2 * | 12/2010 | Zimmermann | E21B 19/07 166/379 |
| 8,689,863 | B2 * | 4/2014 | Angelle | E21B 19/07 166/77.52 |
| 2005/0173154 | A1 | 8/2005 | Lesko | |
| 2006/0124305 | A1 * | 6/2006 | Juhasz | E21B 19/07 166/285 |
| 2007/0000668 | A1 * | 1/2007 | Christensen | E21B 19/06 166/380 |
| 2009/0121507 | A1 * | 5/2009 | Willis | E21B 19/07 294/86.26 |
| 2011/0174542 | A1 * | 7/2011 | Sinclair | E21B 17/00 175/57 |
| 2015/0275592 | A1 * | 10/2015 | Wood | E21B 19/16 166/380 |

* cited by examiner

ELEVATOR DEVICE FOR DRILLING SYSTEMS

BACKGROUND OF THE INVENTION

The present invention relates to an elevator device for drilling systems.

As is known, well drilling systems conventionally comprise rod locating systems designed for locating the drilling rods at a proper working position.

Prior systems are controlled by an operator arranged at the drilling plane, for manually mounting the drilling rods at a proper position thereof.

This operation involves high operating risks and must be performed by a skilled operator.

Document U.S. Pat. No. 7,140,445 B2 substantially discloses the preamble of claim 1.

SUMMARY OF THE INVENTION

The aim of the present invention is to provide such an elevator device overcoming the above mentioned prior art drawbacks.

Within the scope of the above mentioned aim, a main object of the invention is to provide such an elevator device which may operate without an operator at the drilling plane.

Another object of the present invention is to provide such an elevator device which is adapted to operate in a fully automatic manner without any operators at said drilling plane.

Another object of the present invention is to provide such an elevator device which allows to greatly reduce the operating costs, and the number of operators for performing the drilling operations.

Yet another object of the present invention is to provide such an elevator device which, owing to its specifically designed constructional features, is very reliable and safe in operation.

According to one aspect of the present invention, the above mentioned aim and objects, as well as yet other objects, which will become more apparent hereinafter, are achieved by an elevator device according to claim 1.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative but not limitative example, in the accompanying drawings, where.

DESCRIPTION OF THE PREFERRED EMBODIMENTS

Figure 1:
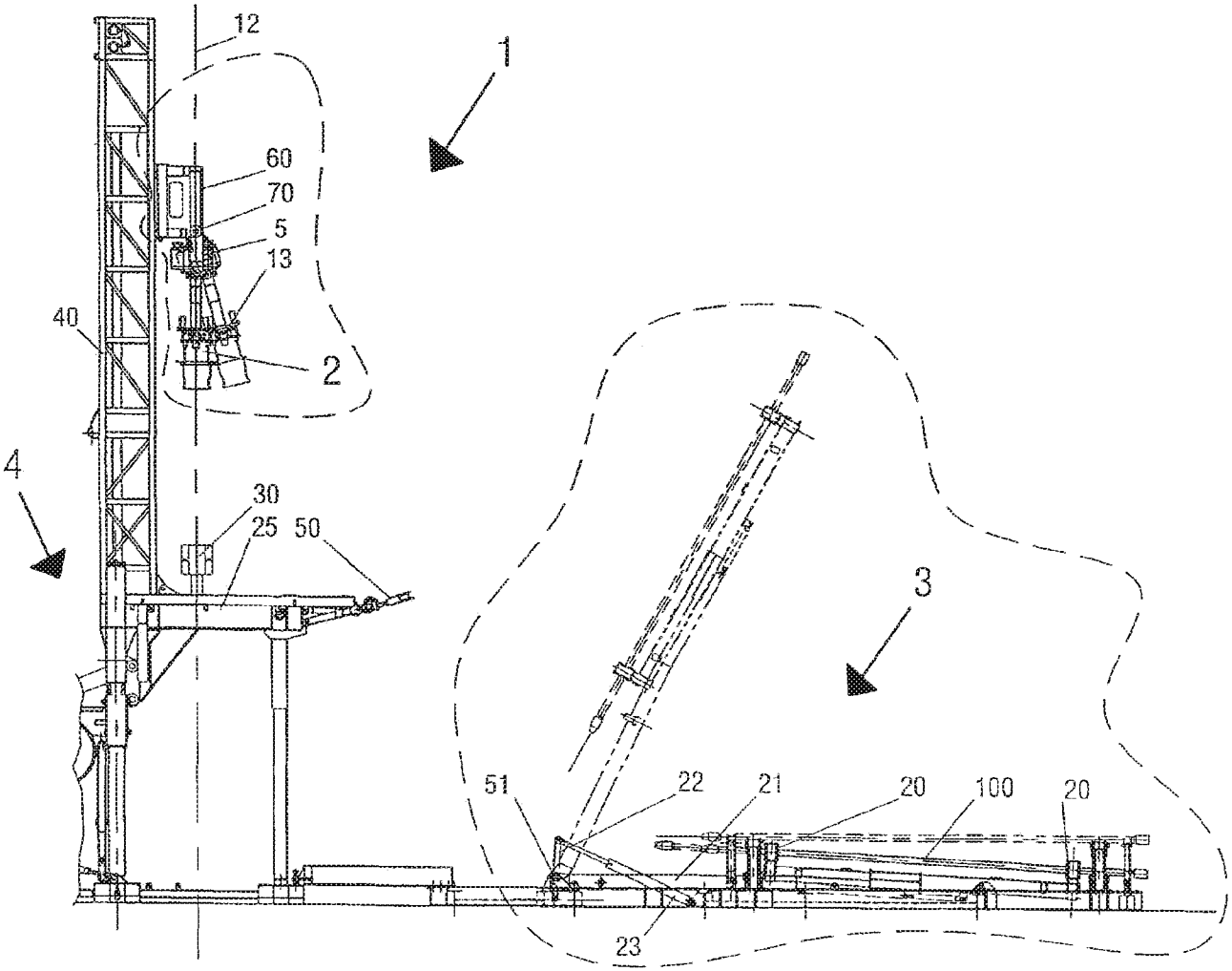
FIG. 1 is a side elevation view showing a drilling machine including the elevator device according to the present invention, and being shown before taking a rod from the rod loader and before turning said rod toward the elevator device.

With reference to the number references of the above mentioned figures, the elevator device according to the present invention, specifically designed to be used in well drilling systems, comprises a plurality of operating devices, generally indicated by the reference number 1 and more specifically a lifting or elevator device 2 mounted on a driving head 5 designed for turning or rotating on an orthogonal pivot pin 70, in the drilling direction 12, said driving head 5 being in turn mounted on a driving carriage 60 which can slide in the vertical drilling direction 12.

More specifically, the lifting device 2 operates by cooperating with a loader 3 applied to a drilling machine 4.

Said lifting device 2, constituting a main part of the present invention, allows to take a drilling rod 100 or a casing 101 from an oblique position defined by the loader 3, and screw-on said rod or casing to the driving head 5 of a drilling machine 4 which will rotatively drive said rod or casing in the drilling direction 12.

As shown, the lifting device comprises an outer body 6, of the fixed type, rigid with the driving head frame, and including a plurality of hydraulic cylinders 11, operating expansible shoes 7 which, by sliding on an inclined plane 8 of the inner body 9 turning and rigid with said driving head, will lock on the outside of said inner body said drilling rod 100 or casing 101.

The lifting device 2 operation will be disclosed in a more detailed manner with reference to the following method.

The drilling machine 4, as stated, comprises a loader or loading device 3, including an arm 21 which, in a normal condition, is arranged in a horizontal position and is designed for turning about a pivot pin 51 orthogonal to said arm 21.

The rod 100 or casing 101, clamped by clamping grippers 20 arranged on the arm 21, are rotatively driven by a hydraulic cylinder 23 coupled to a leverage system 22.

The hydraulic device 23 operating the arm 21 of the loader or loading device 3 rotatively drives said rod 100 or casing 101, after having fixedly coupled the latter to the arm 21 by the grippers 20 applied to the arm 21 of the loader 3.

Said grippers 20 are hydraulically driven and are closed by restraining the rod 100 or casing 101, as the latter are arranged at a horizontal position contacting the arm 21.

Figure 2:
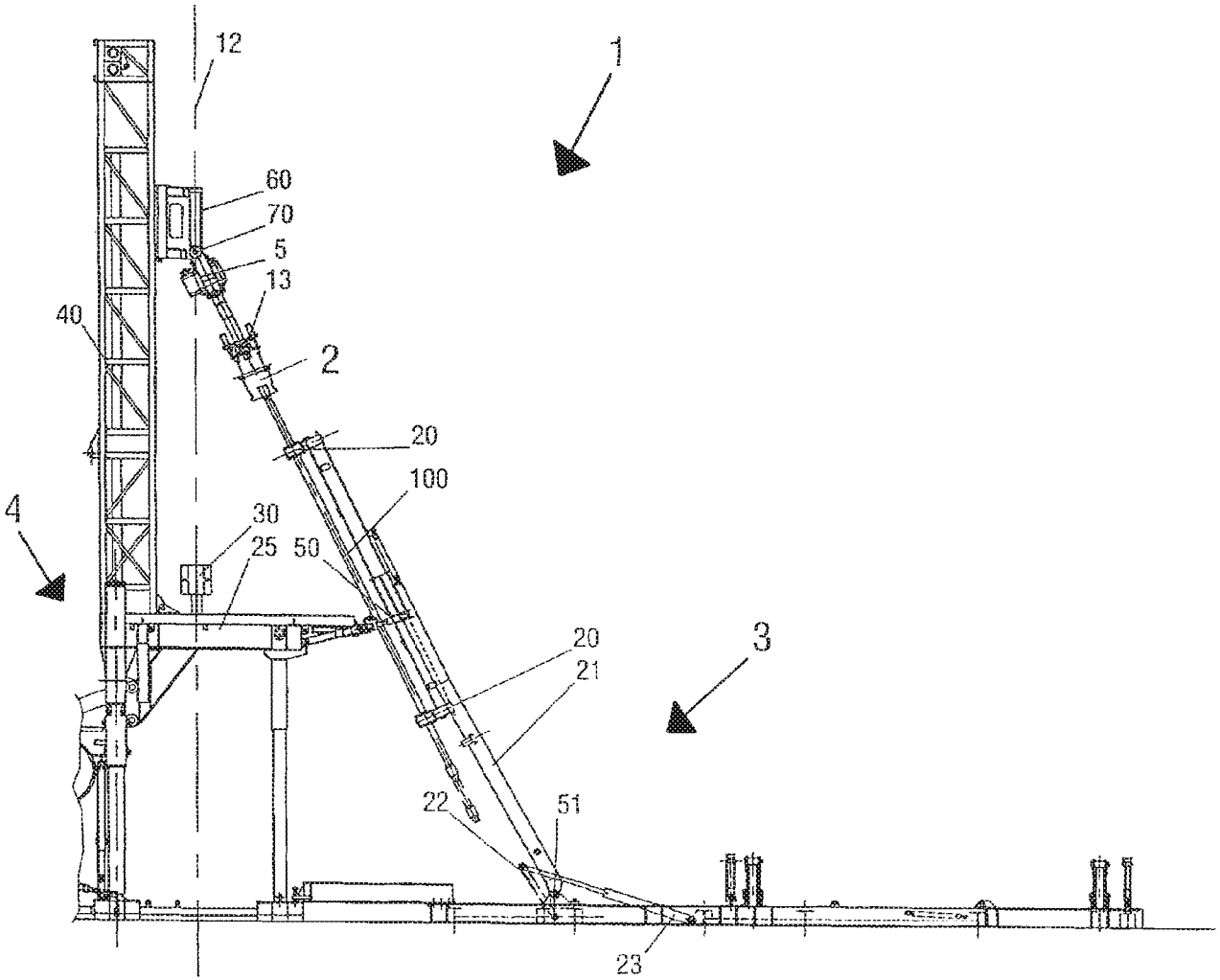
FIG. 2 is a view similar to FIG. 1, but showing the drilling rod arranged in the drilling rod loader and facing the drilling machine with the elevator device facing a position suitable for receiving the drilling rod.
Figure 3:
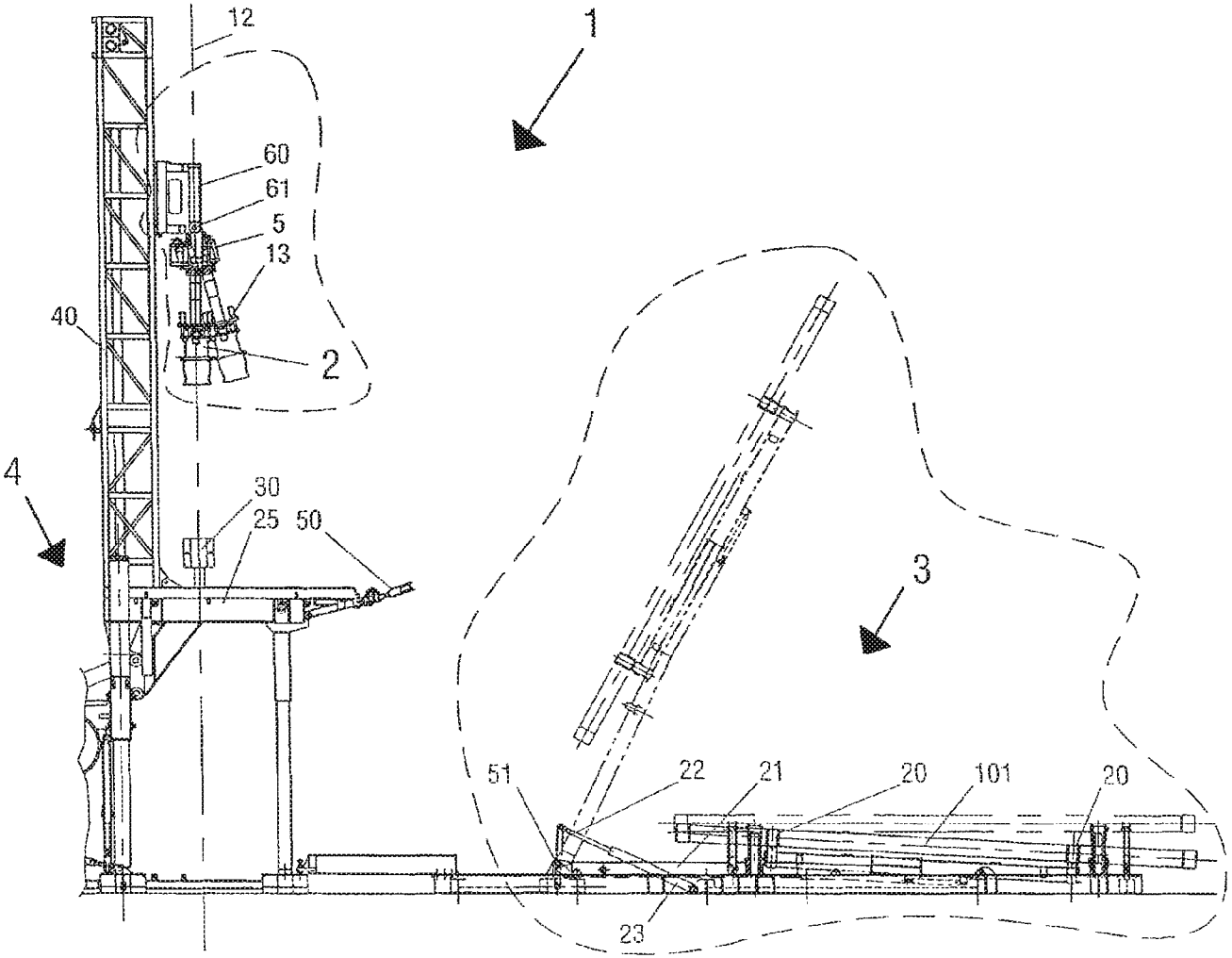
FIG. 3 is an elevation view showing a drilling machine including the elevator device according to the present invention, and being shown before removing a casing from the loader.
Figure 4:
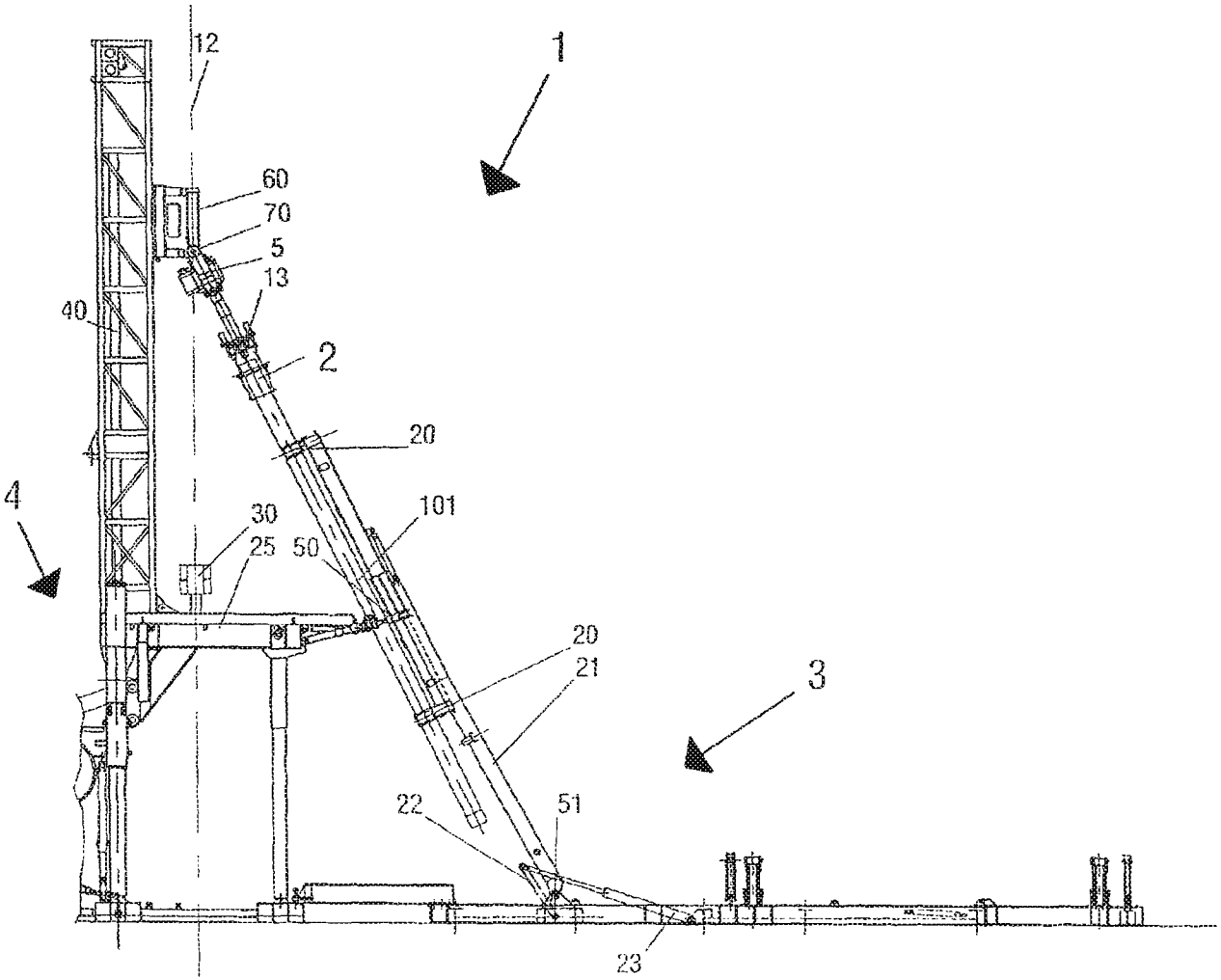
FIG. 4 is a view similar to FIG. 3, but showing the casing arranged in the loader and facing the drilling machine with the elevator facing a position suitable for receiving the casing.

Then, the hydraulic cylinder 23, while pushing the leverage system 22 applied to the arm 21 of the loader or loading device 3, causes said rod 100 or casing 101 to partially turn about the pivot pin 51, to cause them to abut on the top of a stop or detent element 50 applied on a probing plane 25 of the drilling system 4, as schematically shown in FIGS. 1 and 2 for the rods 100 and in FIGS. 3 and 4 for the casing 101.

As shown, the lifting device 2 is coupled to the driving head 5 by a wear reducing element 13, which is locked by two locking pins 14 to the rotary inner body 9 and includes an inlet 61 and expansible shoes 7, which slide on an inclined plane 8 thereby locking the drilling rod 100 or casing 101.

The rotary inner body 9 is mounted on mounting bearings 10 and comprises a lubricating system.

The fixed outer body 6 houses two operating cylinders 11 driving said expansible shoes and is held at a set position owing to an anti-turning arm 62, rigid with the driving head frame.

Said rod 100 or casing 101 are gripped or taken by aligning the driving head 5 coupled to the lifting device 2, with the rod 100 or casing 101 to be gripped by the loader arm 21.

As stated, the lifting device 2 comprises an inlet portion 61 having a bottom tapering, allowing to introduce into the body of the lifting device 2 a top end portion of the rod 100 or casing 101.

Figure 5:
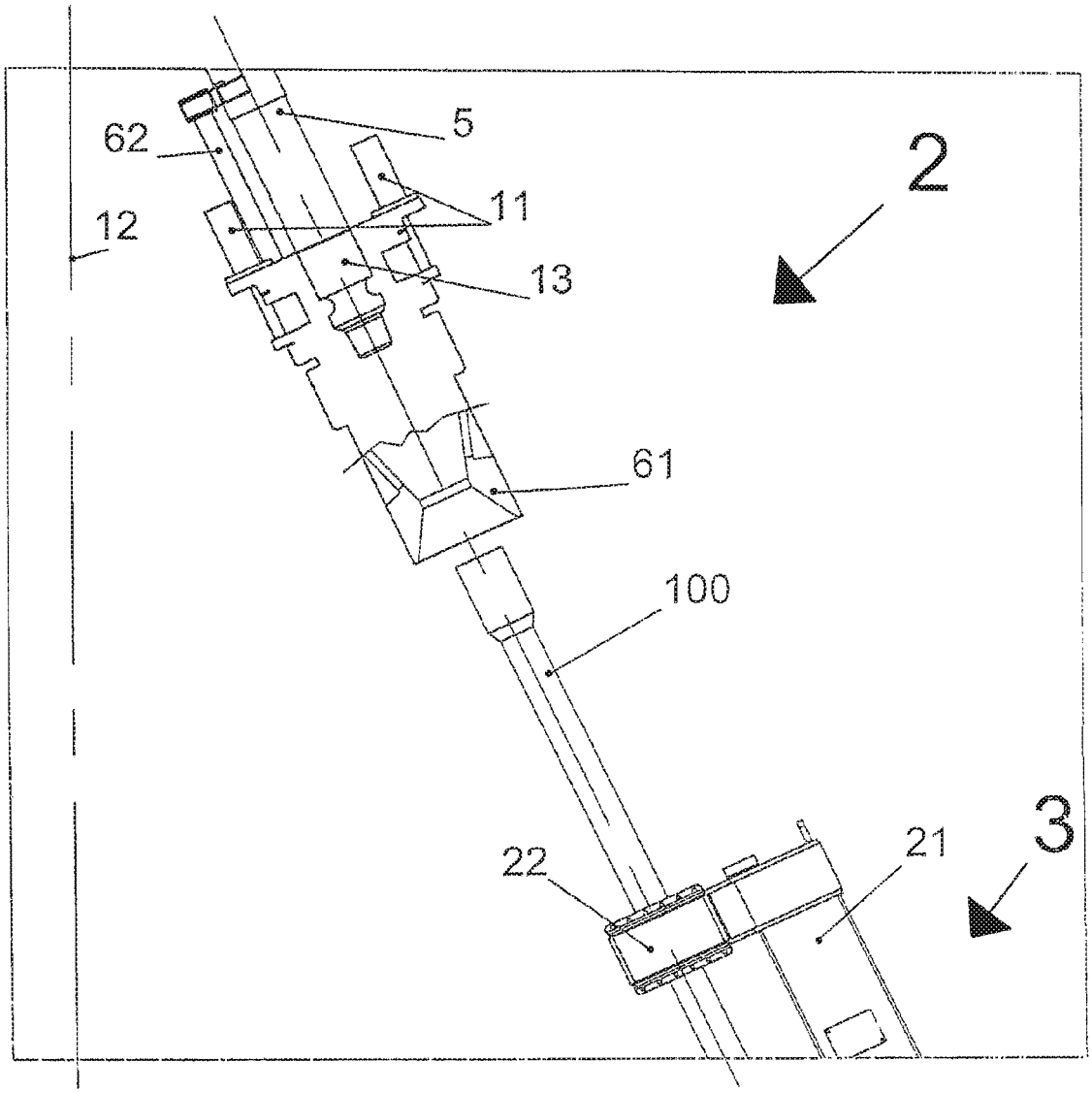
FIG. 5 is a detailed view of the elevator device at an operating step before the engagement of a drilling rod.
Figure 6:
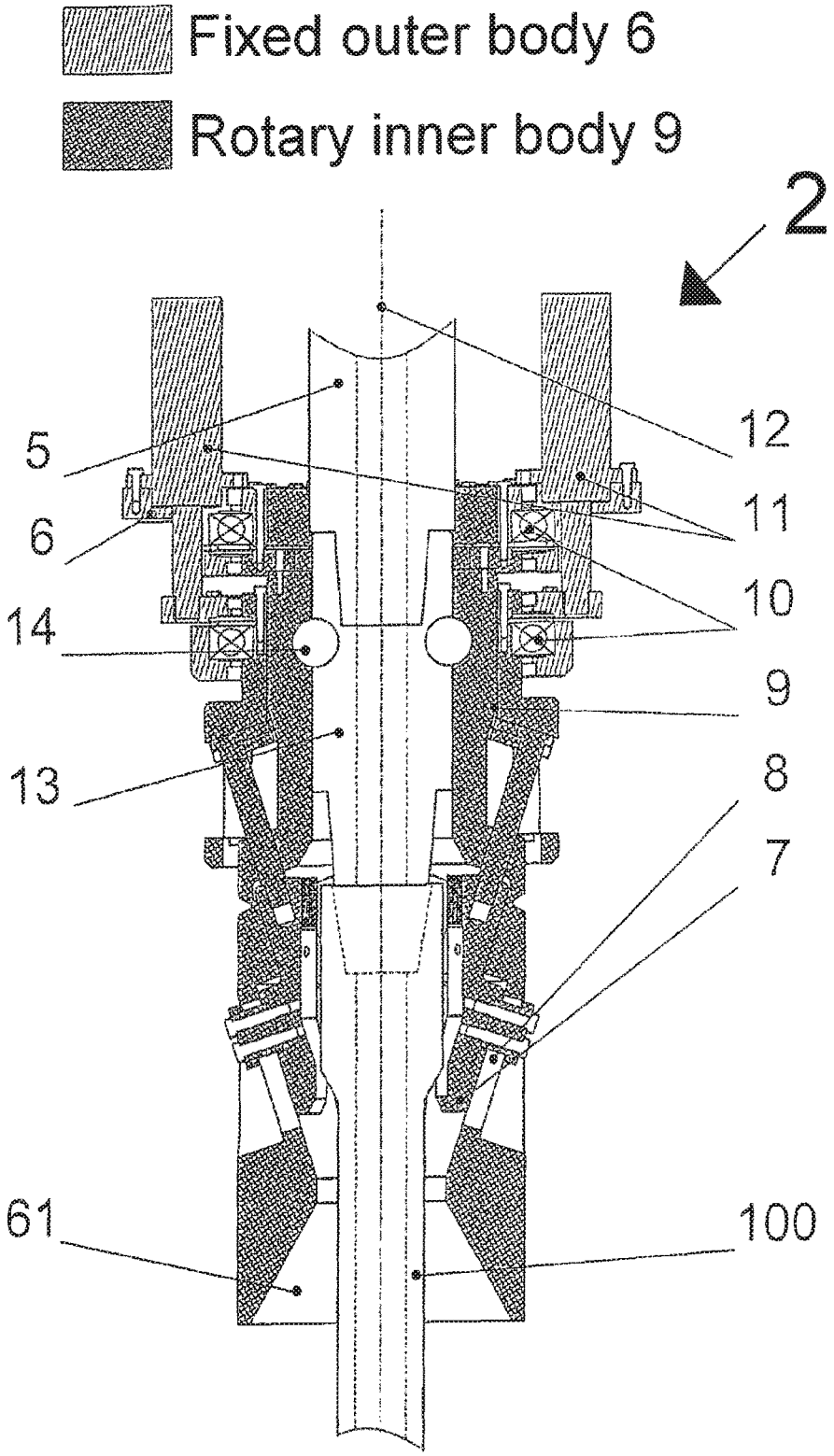
FIG. 6 is a cross-sectional view of the elevator device during the drilling rod mounting operation, and clearly showing the rotary inner body coupled to the driving head and the fixed outer body coupled to the driving head frame.
Figure 7:
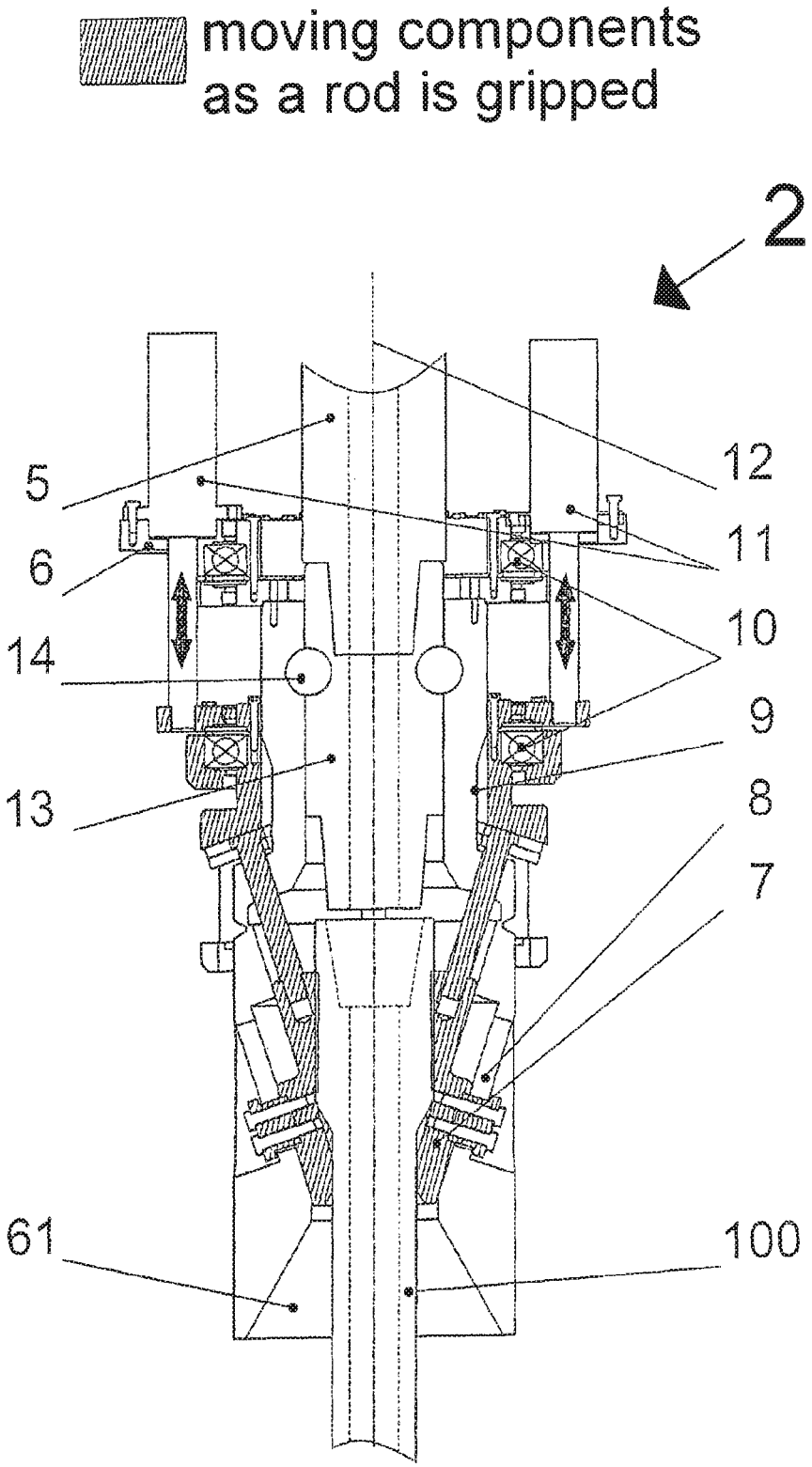
FIG. 7 is a view similar to FIG. 6, showing the movement of the sliding shoes, performed upon operating the driving cylinders and locking the drilling rod.
Figure 8:
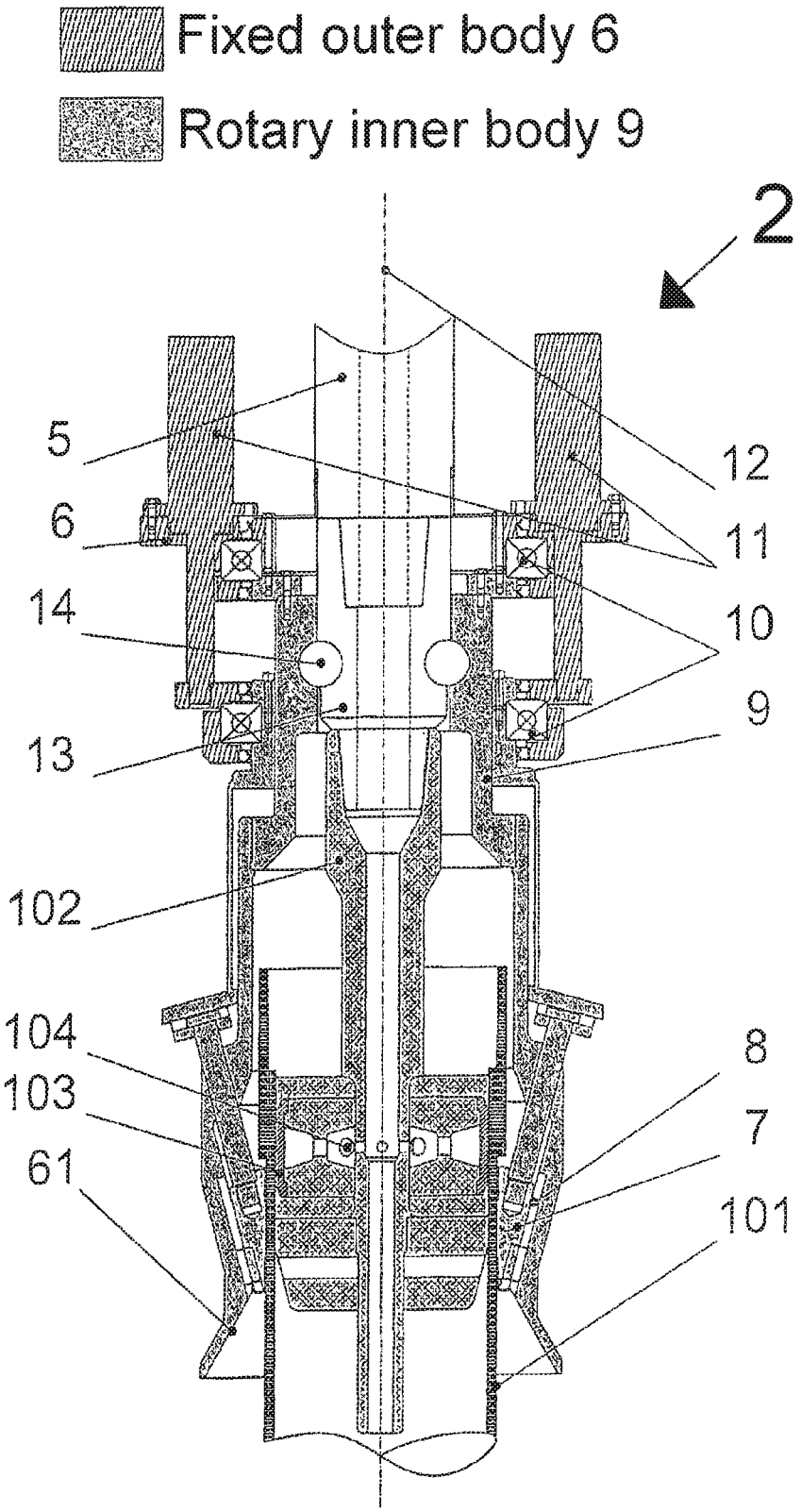
FIG. 8 is a cross-sectional longitudinal view of the elevator device being represented in a casing locking operating step, wherein the detail 102 is clearly shown, whose operation will be more clearly disclosed hereinafter.

This operation is facilitated by the tapering arrangement of the bottom inlet 61 of the lifting device 2, as clearly shown in FIG. 5.

Thus, after having engaged the top end portion of the rod 100 or casing 101, the cylinders 11 driving the shoes 7 and locking the rod 100 or casing 101 are operated.

It should be pointed out that, in this operating step, the shoes 7 would allow to grip a rod 100 under a threaded end portion 108 thereof, or tool joint, thereby providing a gravity type of coupling.

To allow the lifting device 2 to grip the rod 100 or casing 101, the grippers 20 of the loader 3 arm 21 must be opened.

The gripping of the rod 100 or casing 101 by the lifting device 2 is achieved by axially pushing the shoes 7 of the rotary body 9 by the cylinders 11 applied to the fixed outer body 6 of the lifting device 2.

Said cylinders 11 are adapted to provide a downward directed pushing force, thereby allowing the shoes 7 to lock from outside the rod 100 or casing 101.

After having coupled to the lifting device 2 the rod 100 or casing 101 by the pressing cylinders 11 operating the shoes 7, the grippers 20 of the arm 21 are opened, thereby said rod 100 or casing 101 are locked.

As stated, the lifting device 2 is coupled to the driving head 5 providing, in addition to a rotary movement of the rod about the drilling direction 12, also a rotary movement perpendicular to the pin 70 axis.

The driving head 5 is vertically driven by the carriage 60 to which it is coupled by coupling pins 70, thereabout said driving head is rotatively driven to bring the rod 100 or casing 101 to a vertical position along the drilling direction 12.

The driving head 5 is coupled by coupling pins 70 to the carriage 60 which may perform an upward or downward vertical movement along guides formed in the body of vertical trellis framework 40 of the drilling machine 4 and being adapted to arrange said rod 100 or casing 191 at a main gripper assembly 30 included in the drilling machine 4.

The shoes 7 of the lifting device 2 allow moreover said rod 100 or casing 5 to be screwed on and off during the connecting/disconnecting operations.

The rod 100 or casing 101 are released after having screwed-on them to the rod 100 or casing 101 already introduced into the well.

In case of an operating in a drilling step, and accordingly using the rods 100, upon releasing the rod 100 by the shoes 7, it is possible to downward slide all the assembly 1 and actively drive the driving head 5 and lifting device 2 about the vertical drilling direction 12, thereby coupling the rod 100 to the wear reducing element 13.

After having connected the driving head 5 and drilling rod 100, it is possible to actuate the mud circulating system by the driving head, thereby allowing the drilling operation to be recovered.

In case of using a casing 101, that is during the well casing operations with the mud circulation, it is necessary to use the detail 102, which is a component element to be arranged in the rotary body 9 of the lifting device 2.

It should be pointed out that the device 102 comprises a gasket 103 which, through central ports 104, is inflated within the casing 101, thereby allowing the pressurized mud to be circulated through the casing 101.

Thus, in these conditions it is possible to make a mud circulating system like that achieved during the use of the lifting device 2 with the rod 100 upon screwing on the rod 100 to the wear reducing element 13 and accordingly to the driving head 5.

From the above it should be apparent that the detail 102 will hold the casing 101 in a locked condition, even from the inside, while allowing a circulation and consequent pressurizing of the mud.

The rod 100 or casing 101 are released or disconnected by using two cylinders 11 controlled by the driving components of the drilling machine 4.

The invention claimed is:

1. An elevator device applied to a drilling machine (4), said elevator device comprising a driving head (5) rotatably mounted by means of a pivot pin (70) on a driving carriage (60) which is slidable on said drilling machine (4) in a vertical drilling direction (12), and a lifting device (2) mounted on the driving head (5) and cooperating with a rod (100) or casing (101) loading device (3) of said drilling machine (4); said loading device (3) being adapted to take a rod (100) or a casing (101) from a horizontal position to successively engage said rod or casing in said lifting device (2) mounted on said driving head (5) of said drilling machine (4), said driving head (5) having a driving head (5) frame, and said lifting device comprising an outer fixed body (6) rigidly fixed with said driving head (5) frame to be driven by said driving head, said lifting device (2) further comprising a rotary inner body (9) that is rotatably mounted inside said outer fixed body (6) by means of mounting bearings (10), said rotary inner body (9) having expansible shoes (7) mounted thereon which are slidable on an inclined plane (8) extending at an inclined angle between said vertical drilling direction (12) and a plane extending perpendicularly to said vertical drilling direction (12), said lifting device (2) further comprising hydraulic cylinders (11) connected between said outer fixed body (6) and said expansible shoes (7) to slide said expansible shoes (7) on said inclined plane (8) thereby for locking said drilling rod (100) or casing (101).

2. An elevator device, according to claim 1, wherein said loading device (3) includes a loading device arm (21), turning about a pivot pin (51) perpendicular to said arm (21) and causing said rod (100) or casing (101) to be rotatively driven by a hydraulic cylinder (23) coupled to a leverage (22) and to said arm (21); said arm (21) including grippers (20) driven by hydraulic cylinders for causing said grippers to be opened and closed.

3. An elevator device, according to claim 2, wherein said loading device (3) arm (21) is adapted to take, from a horizontal position, said rods (100) or casings (101), to partially turn said rods (100) or casings (101) about said pivot pin (51) to cause said rod (100) or casing (101) to abut against a detent element (50), applied to a probing plane (25) of said drilling machine (4).

4. An elevator device, according to claim 1, wherein said rod (100) or casing (101) are gripped and lifted by aligning an inclination of said driving head (5) of said lifting device (2) with said rod (100) or casing (101) taken by said loading device (3), said driving head (5) having a bottom tapering, said lifting device having a tapered bottom inlet (61) thereby, upon having introduced a top end portion of said rod (100) or casing (101), said lifting device (2) is connected to a wear reducing element (13) of said driving head (5) and being locked by two locking pins (14).

5. An elevator device, according to claim 1, wherein said lifting device (2) comprises a top portion having an anti-rotary arm preventing said lifting device (2) from turning; said lifting device (2) including said expansible shoes (7) for gripping said rod (100) under a threaded end portion (107) thereof with a coupling carried out by gravity or by a threading operation.

6. An elevator device, according to claim 1, wherein said lifting device (2) comprises said expansible shoes (7) allowing said rod (100) or casing (101) to be threaded on unthreaded in an assembling operation thereof; thereby, to allow said lifting device to engage said rod (100) or casing (101), said grippers (20) are at first opened; said rod (100) or casing (101) being introduced into said driving head (5) by axially pushing said rod or casing by said hydraulic cylinders (11) of said lifting device (2).

7. An elevator device, according to claim 1, wherein said elevator device comprises a device (102) including a gasket (103) which, through central ports (104) is pressurized to hold said casing (101) even from an inner region thereof, thereby providing a mud circulating system, like when said lifting device (2) is used with said rod (100), the device (102) holding said casing (101) in a locked condition even from inside said casing (101).

8. An elevator device, according to claim 6, wherein, upon having engaged the lifting device (2), said rod (100) or casing (101), being pressed by said hydraulic cylinders (11) of said lifting device (2), said grippers (20) of said arm (21) are opened thereby locking the rod (100) and casing (101) by the head (5) of the lifting device (2); said lifting device (2) being then raised to be aligned with said vertical drilling direction (12).

9. An elevator device, according to claim 1, wherein said lifting device (2) comprises said carriage (60) adapted to perform an upward and downward vertical movement along guides formed on a body of a trellis (40) of said drilling machine (4) and being adapted to arrange said rod (100) or casing (101) at a main gripper (30) included in said drilling machine.

10. An elevator device, according to claim 1, wherein said rod (100) or casing (101) are released by said hydraulic cylinders (11) controlled by driving elements of said drilling machine (4).

11. An elevator device, according to claim 1, characterized in that said driving head (5) comprises a top portion including an anti-rotary arm (62) preventing said outer fixed body (6) of the lifting device (2) from turning; said expansible shoes (7) engaging said rod (100) under a threaded portion thereof, thereby providing a coupling or threading by gravity; said expansible shoes (7) allowing said rod (100) or casing (101) to be threaded or unthreaded to or from rods already engaged in the soil.

* * * * *